US008292298B2

(12) United States Patent
Strum

(10) Patent No.: US 8,292,298 B2
(45) Date of Patent: Oct. 23, 2012

(54) FOLDING GAME BOARD

(76) Inventor: Gary Strum, New York, NY (US)

( * ) Notice: Subject to any disclaimer, the term of this patent is extended or adjusted under 35 U.S.C. 154(b) by 1628 days.

(21) Appl. No.: 11/283,263

(22) Filed: Nov. 18, 2005

(65) Prior Publication Data

US 2006/0108737 A1 May 25, 2006

Related U.S. Application Data

(60) Provisional application No. 60/629,879, filed on Nov. 19, 2004.

(51) Int. Cl.
*A63F 3/00* (2006.01)

(52) U.S. Cl. ..... 273/285; 273/287

(58) Field of Classification Search ..... 273/283, 273/284, 285, 287
See application file for complete search history.

(56) References Cited

U.S. PATENT DOCUMENTS

| | | | | |
|---|---|---|---|---|
| 1,024,194 | A * | 4/1912 | Frank | 273/236 |
| 1,793,256 | A | 2/1931 | Shulman | |
| 2,147,900 | A * | 2/1939 | Houseknecht | 273/285 |
| 2,722,425 | A * | 11/1955 | Gazelle | 273/142 R |
| 3,902,724 | A | 9/1975 | Hersey | |
| 4,696,476 | A * | 9/1987 | Eplett | 273/241 |
| 4,709,928 | A | 12/1987 | Willingham | |
| 4,834,390 | A | 5/1989 | Phillips | |
| 5,100,151 | A | 3/1992 | Lyon et al. | |
| 5,145,184 | A | 9/1992 | Yearick | |
| 5,178,396 | A | 1/1993 | Lyon et al. | |
| 5,222,657 | A | 6/1993 | Holland, Jr. | |
| 5,388,838 | A | 2/1995 | Bohrer | |

FOREIGN PATENT DOCUMENTS

| | | |
|---|---|---|
| WO | WO 89/08482 | 9/1989 |
| WO | WO 92/04088 | 3/1992 |
| WO | WO 97/17117 | 5/1997 |
| WO | WO 02/24287 A1 | 3/2002 |

* cited by examiner

*Primary Examiner* — Vishu K Mendiratta
(74) *Attorney, Agent, or Firm* — Johnson, Marcou & Isaacs, LLC

(57) ABSTRACT

A folding game board is provided for use with game pieces. The system includes a flat game board which comprises four panels. Each panel comprises a playing surface and a compartment opposite the playing surface. Certain panels are hinged together to permit each of two pairs of compartments to fold and close independently to form two storage areas within which playing pieces may be stored. Other panels are hinged together to permit the two storage areas to be folded together, thereby stacking the four panels of the game board. The depth of the storage areas is based on the size necessary to accommodate playing pieces and accessories to be stored within the game board.

27 Claims, 6 Drawing Sheets

FOLDING GAME BOARD

RELATED APPLICATION

The present application claims priority under 35 U.S.C. §119(e) to U.S. Provisional Patent Application No. 60/629,879 entitled, "Folding Game Board System," filed on Nov. 19, 2004. The complete disclosure of the above-identified priority application is hereby fully incorporated herein by reference.

FIELD OF THE INVENTION

The present invention relates generally to game boards. More specifically, the present invention relates to folding game boards which form enclosures whereby playing pieces may be stored therein.

BACKGROUND OF THE INVENTION

A useful feature of a game board is a playing surface large enough for users to utilize comfortably. Additionally, a feature by which the game board can fold economizes storage space, as does a feature by which playing pieces may be stored within the game board and kept ready for use. Each of these features and considerations enhance the convenience for use, portability, and storage of a game board.

Conventional game boards fold along an axis so that the game board can be folded to form two similar halves. Each of these halves may be recessed so that when folded together they combine to form an enclosed storage area. Playing pieces associated with the game board, such as chess pieces for a chessboard, may be stored within such a storage area. Regarding the size of such a storage area, a conventional game board which folds in half generally provides the appropriate surface area (neither too small nor excessively spacious) to accommodate a full relatively-sized set of horizontally-arranged chess pieces. Additionally, as even the largest playing piece for the game of chess fits within one chessboard square, the enclosure's minimum depth may be based on the measure of the side of one chessboard square in order to accommodate the playing pieces stored horizontally. As the two recessed halves of such a conventional game board combine to produce the enclosed storage area, and as the depth of the enclosed storage area is the size of one side of one chessboard square deep, the depth of each of the two recessed halves is half the depth of the enclosed storage area, that is, one-half the size of one side of one chessboard square deep.

Some conventional game board designs fold along multiple axes, which permits larger game boards to be folded into more convenient sizes. For example, a game board may be folded into quarters rather than halves. This type of game board is made by placing a cut in the playing surface by which two adjacent quarters of the game board separate and move apart when the game board is folded. While this type of conventional folding game board offers the convenience of size, it does not permit the possibility of storing playing pieces.

Conventional game boards that both fold along multiple axes and provide storage space exist. One conventional design includes a game board that folds into quarters. Two of those quarters, the opposite sides of which comprise half of the playing surface, have recessed bottoms which fold and close together to form an enclosure within which playing pieces may be stored. The other two sections, the opposite sides of which comprise the other half of the playing surface, do not have recessed bottoms; these two sections are the same size as the sections which are recessed, and these two sections fold and stack upon the enclosure. The folded board creates one enclosure having a surface area that is only one-fourth the size of the game board, which is about one-half the surface area afforded by a game board that folds in half. This conventional design provides a small storage area suitable for only small game pieces, such as checkers. As discussed above, the necessary area of the storage compartment for playing pieces associated with certain game boards, such as chess pieces arranged horizontally, is approximately the surface area afforded by a conventional game board which folds in half, that is, the surface area created by a surface area of one-half a chessboard, with a depth of the size of one side of a chessboard square. Although the storage area of such a conventional quarter-folding design may be made deeper in order to accommodate a similar volume of contents, that modification would necessitate a corresponding thickening of all four sections, and that conventional quarter-folding design would thus yield a cumbersome and inefficient design if used for larger playing pieces, such as chess pieces. Accordingly, conventional quarter-folding game boards do not offer the storage area conveniences of conventional game boards that fold in half.

Thus, a need presently exists in the art for a game board that offers the advantages of sufficient storage area space for playing pieces of a game board that folds in half as well as the advantages of the compactness of a game board that folds in quarters.

SUMMARY OF THE INVENTION

The present invention is a folding game board comprising four quarter panels. The quarter panels are formed and attached such that when unfolded and opened they provide surfaces that form a game playing surface; pairs of recessed areas of these four quarter panels can be folded together to form two separate enclosures within which game playing pieces may be stored; and these two enclosures can be folded to stack one upon the other. The combined additional fold, the separate enclosures, the separate quarter panels, and relationships among them which permit the folding, provide enhancements with regard to convenience, portability, and storage of game boards.

These and other aspects, objects, and features of the present invention will become apparent from the following detailed description of the exemplary embodiments, read in conjunction with, and reference to, the accompanying drawings.

DETAILED DESCRIPTION OF EXEMPLARY EMBODIMENTS

Figure 1A:
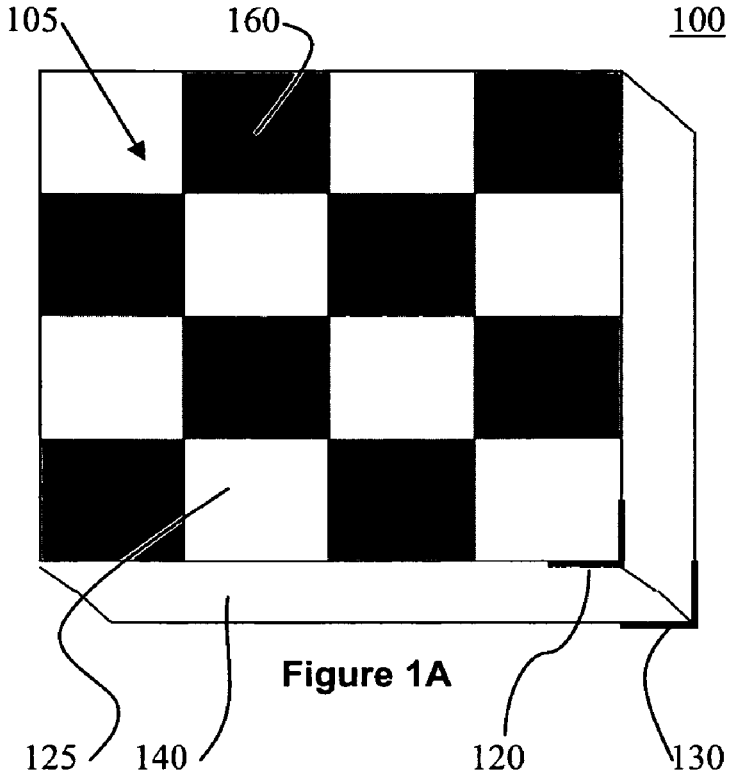
FIGS. 1A and 1B are a top view and a bottom view, respectively, of a quarter panel of a game board according to an exemplary embodiment of the present invention.

Exemplary embodiments of the inventive system will be described in more detail below with reference to the accompanying drawings in which like reference numerals represent like elements.

Figure 1B:
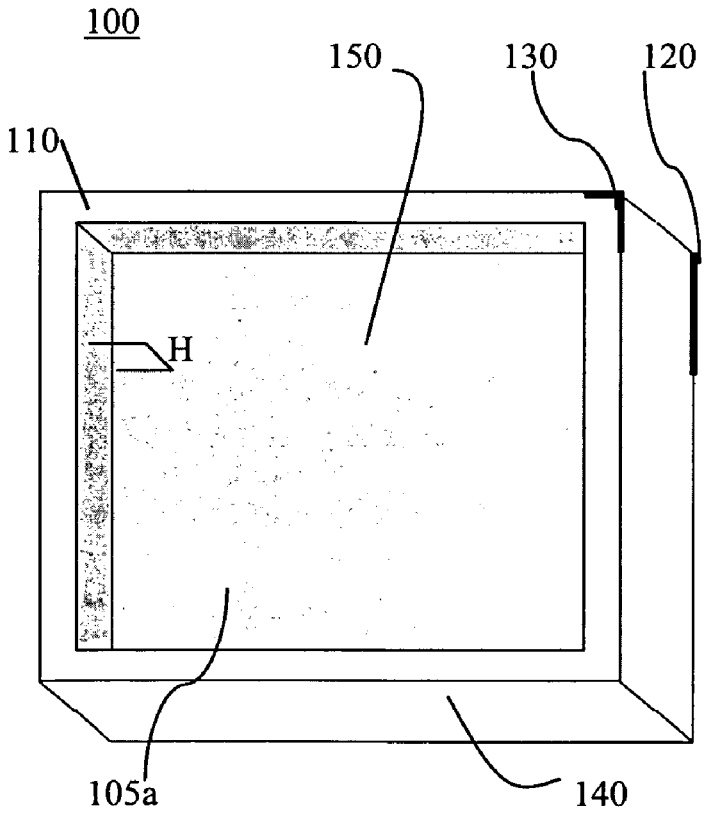

FIGS. 1A and 1B are a top view and a bottom view, respectively, of a quarter panel 100 of a quarter-folding game board according to an exemplary embodiment of the present invention. As shown in FIGS. 1A and 1B, the quarter panel 100 comprises a top surface 105 upon which a portion of a playing surface 125 may be depicted, such as multiple chessboard squares 160. The quarter panel 100 also comprises a top edge 120 along the perimeter of the top surface 105. The quarter panel 100 further comprises four side walls 140 disposed around the perimeter of the playing surface 125. The side walls 140, together with an underside 105*a* of the top surface 105, define a recessed compartment 150. Each side wall 140 comprises a bottom surface 110, and the combined bottom surfaces 110 of each panel 100 define a bottom edge 130 along the perimeter thereof. Although only one corner is highlighted in FIGS. 1A and 1B, the top edge 120 and bottom edge 130 surround the entire top surface 105 and bottom surface 110, respectively, of the quarter panel 100. In an alternative exemplary embodiment, the underside 105*a* may depict a portion of an alternate game playing surface, such as the depiction of a portion of a backgammon board.

A depth H of compartment 150 can be equal to or greater than one-half the dimension of one chessboard square 160. That depth H allows for pieces to fit within the enclosure formed when two quarter panels 100 are stacked together with bottom surfaces 110 facing one another, thereby placing the compartments 150 of two quarter panels 100 opposite each other. In an alternative exemplary embodiment, the depth H of compartment 150 can be varied larger or smaller to accommodate different size pieces and accessories to be stored within the game board 200.

It should be noted that other uses of the invention may be performed without departing from the scope and spirit of the current invention. For example, the dimensions and style of the playing surface 125 may be adapted to play any suitable game, such as backgammon, and compartment 150 may be varied to accommodate game pieces and accessories of varying shapes and sizes, including, but not limited to, accessories such as a chess clock, books, or scoring materials, which might be stored within the storage area within two so-paired compartments 150 of quarter panels 100. Additionally, the compartment 150 may contain molded forms made of foam or plastic, or any other suitable material, in which individual pieces and/or accessories can be placed for storage. Also, as mentioned previously, in an alternative exemplary embodiment the underside 105*a* may depict at least a portion of an alternate game playing surface, such as the depiction of a portion of a backgammon board.

Additionally, the references to "top," "bottom," "underside," and other such references used herein are provided for illustrative purposes only. For example, if the playing surface is provided on the top surface 105, then the quarter panel 100 will be used for games with the top surface 105 facing up. However, if the playing surface is provided on the underside 105*a*, then the quarter panel 100 will be used for games with the top surface facing down.

The quarter panel 100 can be formed of any suitable material. For example, the quarter panel 100 can be formed of materials including, but not limited to, wood, plastic, cardboard, metal, or other suitable material or any combination thereof. Additionally, the material may provide for attraction between the game board and the playing pieces, such as by magnetic or Velcro™ materials.

Figure 2:
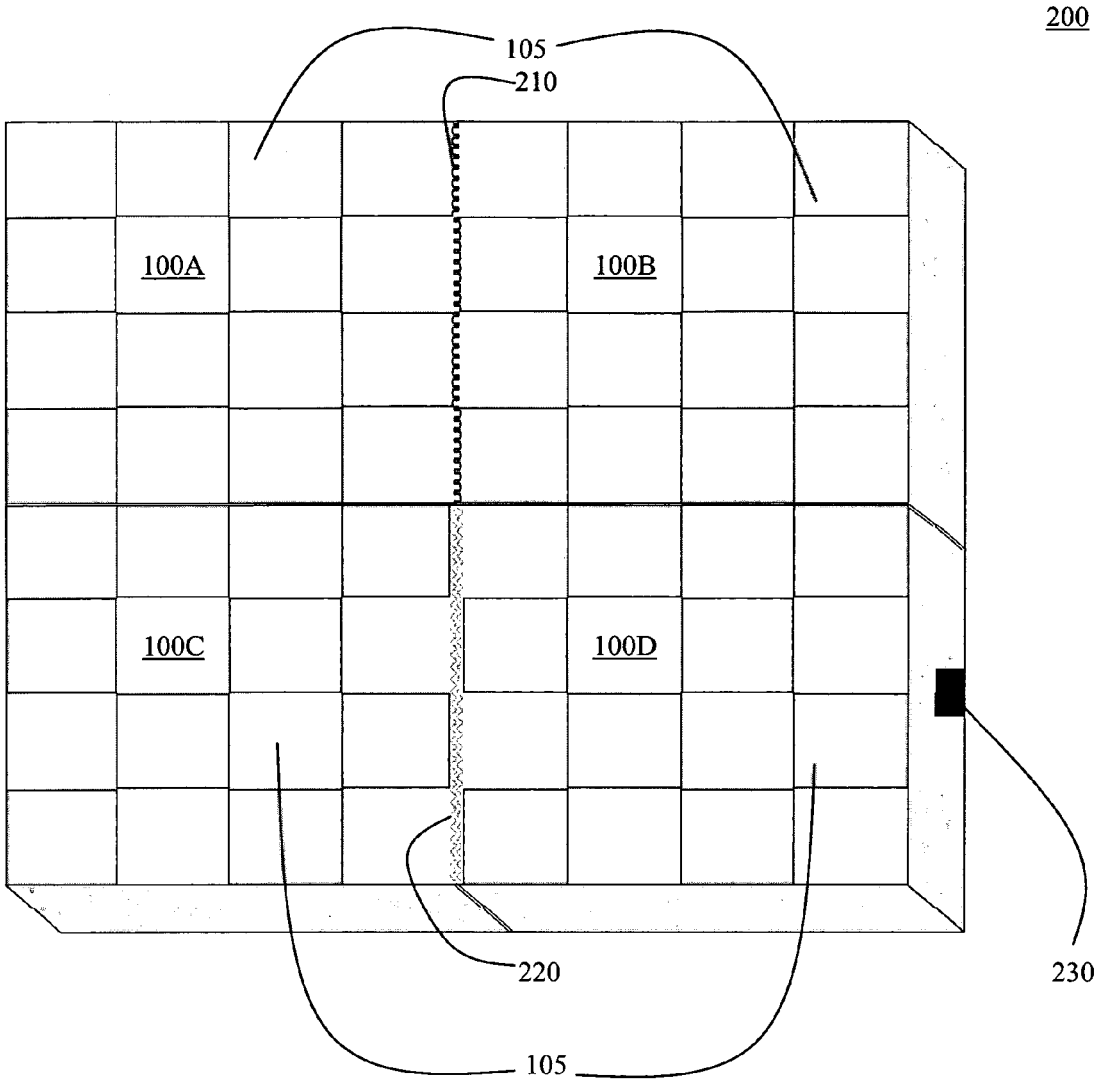
FIG. 2 is a top view of a quarter-folding game board comprising four quarter panels according to an exemplary embodiment of the present invention.

FIG. 2 is a top view of a quarter-folding game board 200 comprising four quarter panels 100 according to an exemplary embodiment of the present invention. As illustrated, the game board 200 comprises four adjacent quarter panels 100A-D. Each of the quarter panels 100A-D includes the components illustrated in FIGS. 1A and 1B. Accordingly, the components of the quarter panels 100A-D are labeled with corresponding identifiers A-D. For example, the top surface of quarter panel 100A is identified as 105A, and the top surface of quarter panel 100B is identified as 105B.

To utilize the board 200 as a playing board, quarter panels 100A-D may be arranged with their top surfaces 105A-D substantially planar to one another. In this way, the bottom surfaces 110A-D (not illustrated in FIG. 2) can rest against a horizontal support, such as a table or floor. Accordingly, when the game board is in its open state, quarter panel 100A is adjacent to quarter panels 100B and 100C, quarter panel 100B is adjacent to quarter panels 100A and 100D, quarter panel 100C is adjacent to quarter panels 100A and 100D, and quarter panel 100D is adjacent to quarter panels 100B and 100C.

According to the exemplary embodiment illustrated in FIG. 2, adjacent quarter panels 100A and 100B are coupled together at their adjoining top edges 120A,B via a top joint 210. The top joint 210 comprises a hinge connecting the quarter panels 100A and 100B. As used herein, the term "hinge" encompasses one or more hinges, flexible plastic, fabric, tape, or other suitable flexible or mechanical attachment or any combination thereof to rotatably attach the quarter panels 100A and 100B. One skilled in the art will understand that top joint 210 can be recessed into the top edges 120A,B to allow the top surfaces 105A,B to face each other when the board 200 is folded along that joint (as will be described in more detail hereinafter).

As illustrated in FIG. 2, the common top and bottom edges of quarter panels 100C and 100D are not coupled together. Quarter panels 100C and 100D are separated by unconnected edges at the location 220. The quarter panels 100C and 100D are not connected at either the top edges 120C,D or the bottom edges 130C,D. Further details concerning location 220 will be explained in more detail with regards to FIGS. 3 through 6. Also shown in FIG. 2 is a latch 230, which will be explained in more detail with reference to FIGS. 3 and 6.

Figure 3:
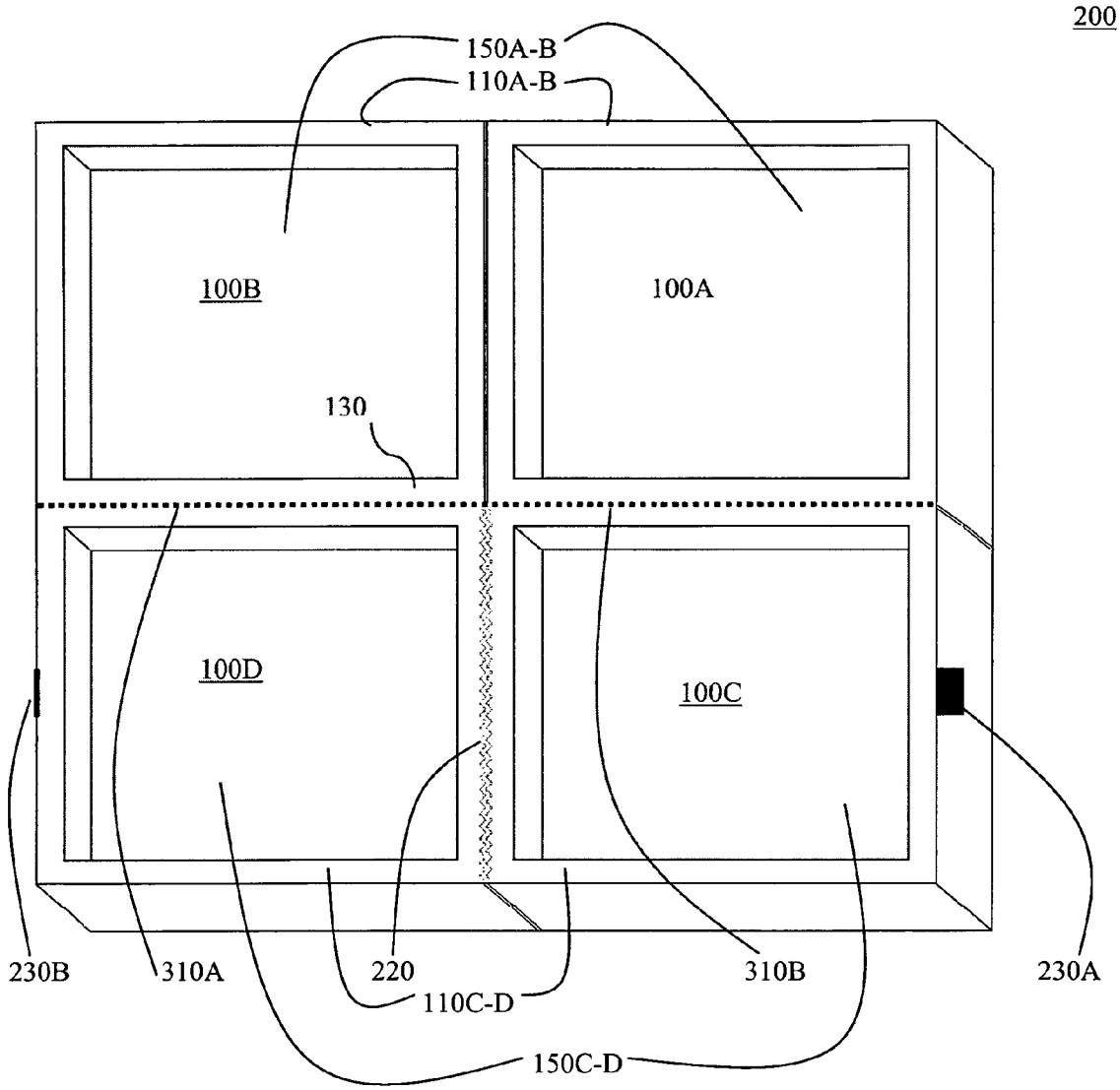
FIG. 3 is a bottom view of the quarter-folding game board according to an exemplary embodiment of the present invention.

FIG. 3 is a bottom view of the quarter-folding game board 200 according to an exemplary embodiment of the present invention. When the board 200 is utilized for storage, playing pieces (not illustrated), such as horizontally-arranged chess pieces, may be stored within the compartments 150A-D.

As is illustrated in FIG. 3, the board 200 further comprises bottom joints 310A and 310B. Adjacent quarter panels 100B and 100D are coupled together at their adjacent bottom edges 130B,D via the bottom joint 310A, and adjacent quarter panels 100A and 100C are coupled together at their adjacent bottom edges 130A,C via the bottom joint 310B. The bottom joints 310A,B can each comprise a hinge. One skilled in the art will understand that bottom joints 310A and 310B can be recessed into the bottom edges to allow the bottom surfaces 110A,C and 110B,D of respective quarter panels 100A,C and 100B,D to lay completely adjacent to one another when the board 200 is folded along those joints (as will be described in more detail hereinafter). In the exemplary embodiment illustrated in FIG. 3, the latch 230 comprises components 330A,B.

Figure 4:
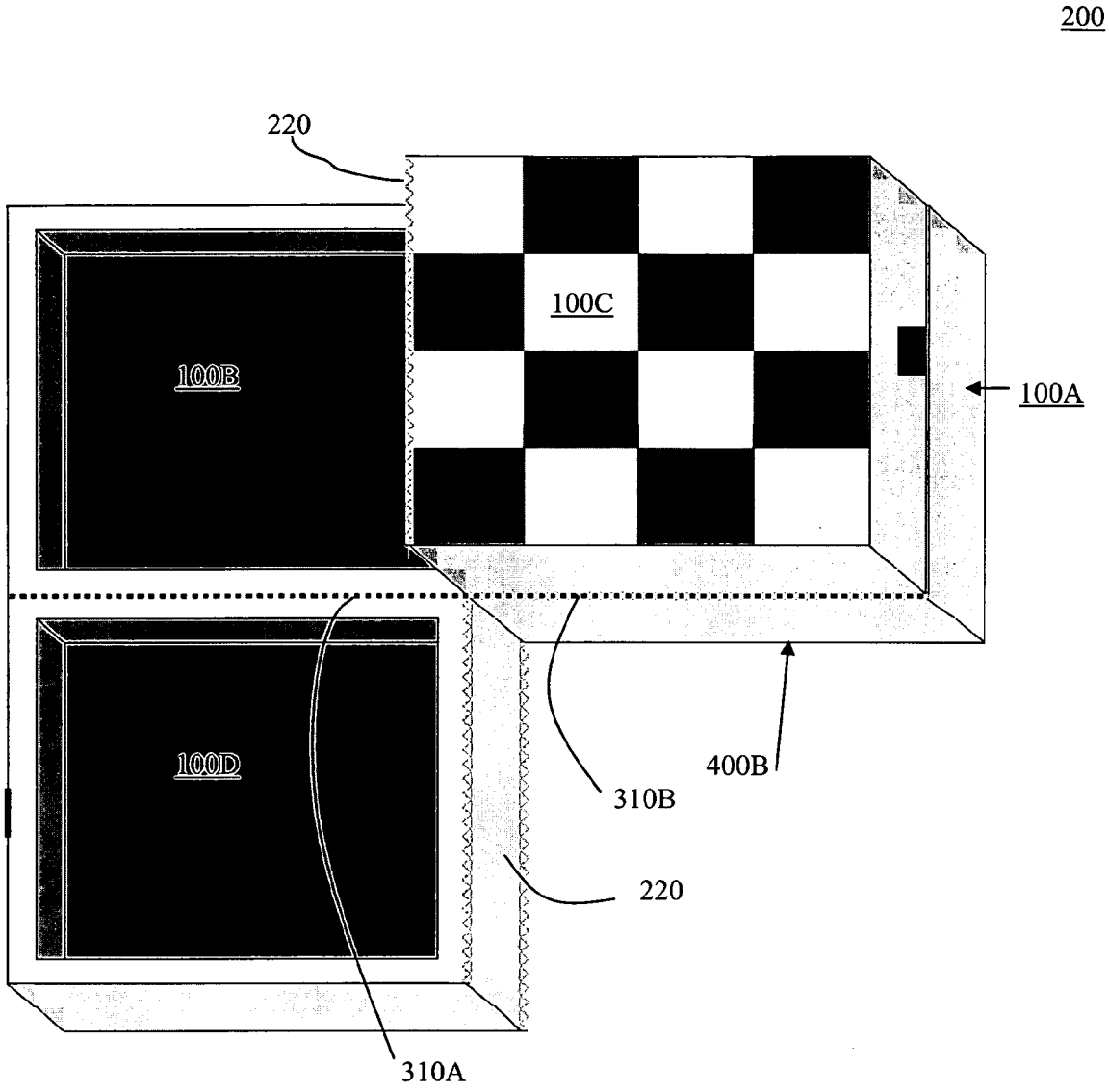
FIG. 4 illustrates the quarter-folding game board with one set of quarter panels folded together forming one enclosure according to an exemplary embodiment of the invention.

FIG. 4 illustrates the quarter-folding game board 200 with one set of quarter panels folded together to form a first enclosure according to an exemplary embodiment of the invention. As shown, quarter panels 100A and 100C are folded together along bottom joint 310B, thereby forming an enclosure 400B in which playing pieces may be stored. This independent folding is permitted due to unconnected edges at location 220, which also allows quarter panels 100C and 100D to separate when the board 200 is folded together for storage (as will be described in more detail hereinafter). The enclosure 400B comprises an internal compartment (not shown) formed from the compartments 150A and 150C. Thus, the enclosure 400B has a depth (not shown) of 2H because it includes the depth H of compartment 150A and the depth H of compartment 150C. In an exemplary embodiment, the compartments 150A and 150C can each have a depth H of one-half of the size of one side of one chessboard square 160 on the playing surface 125, and the resulting enclosure 400B would then have a depth 2H, or the size of one side of one chessboard square 160. Accordingly, the compartment 400B would accommodate any playing piece that fits within a chessboard square 160 on the playing surface 125. In alternative exemplary embodiments, the compartment depth H (and therefore the enclosure 400B depth 2H) can be varied larger or smaller to accommodate any desired size of playing piece or accessory intended to be stored within the enclosure.

Figure 5:
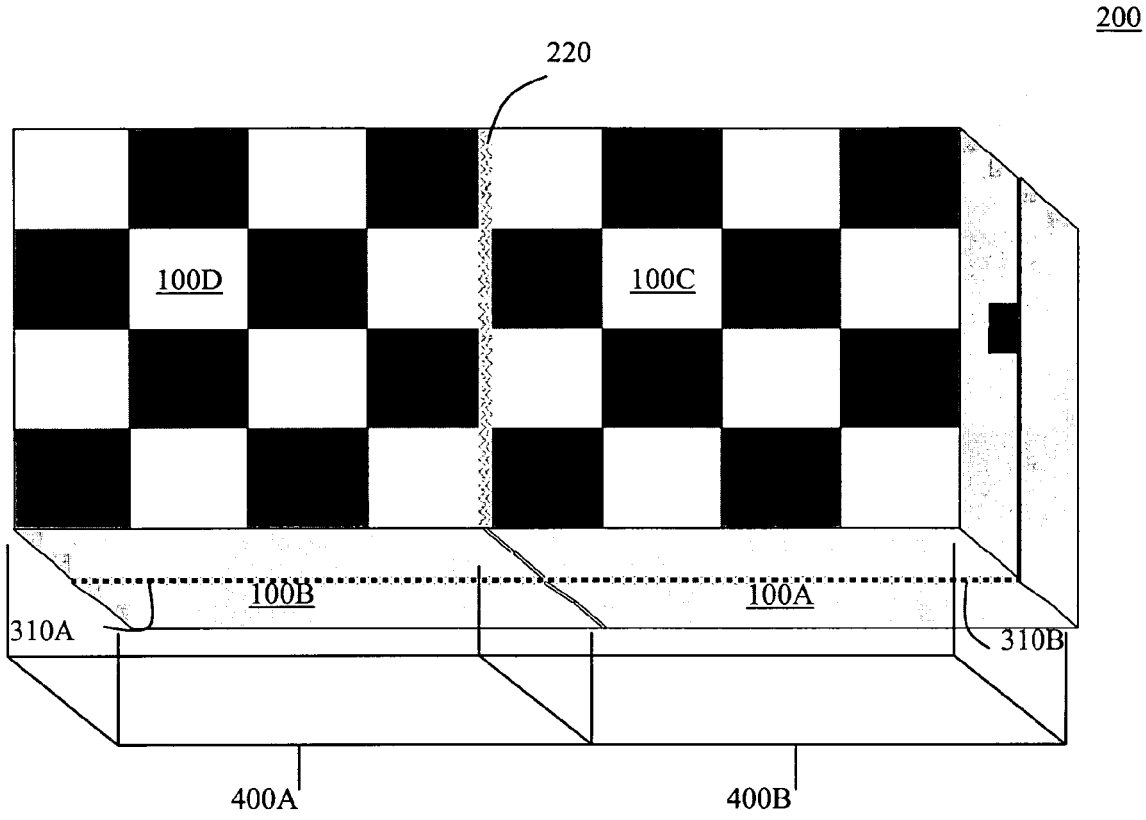
FIG. 5 illustrates the quarter-folding game board with two sets of quarter panels folded together forming two enclosures according to an exemplary embodiment of the present invention.

FIG. 5 illustrates the quarter-folding game board 200 with two sets of quarter panels folded together to form two enclosures according to an exemplary embodiment of the present invention. In addition to the folding together of quarter panels 100A and 100C along bottom joint 310B to form enclosure 400B, as discussed above with reference to FIG. 4, FIG. 5 also depicts quarter panels 100B and 100D similarly folded along bottom joint 310A, thereby forming an enclosure 400A, having similar characteristics as described with reference to enclosure 400B. In FIG. 5, unconnected edges at location 220 between quarter panels 100C and 100D allow the two enclosures thus formed, 400A and 400B, to be folded at top joint 210 as described in more detail with reference to FIG. 6.

Figure 6:
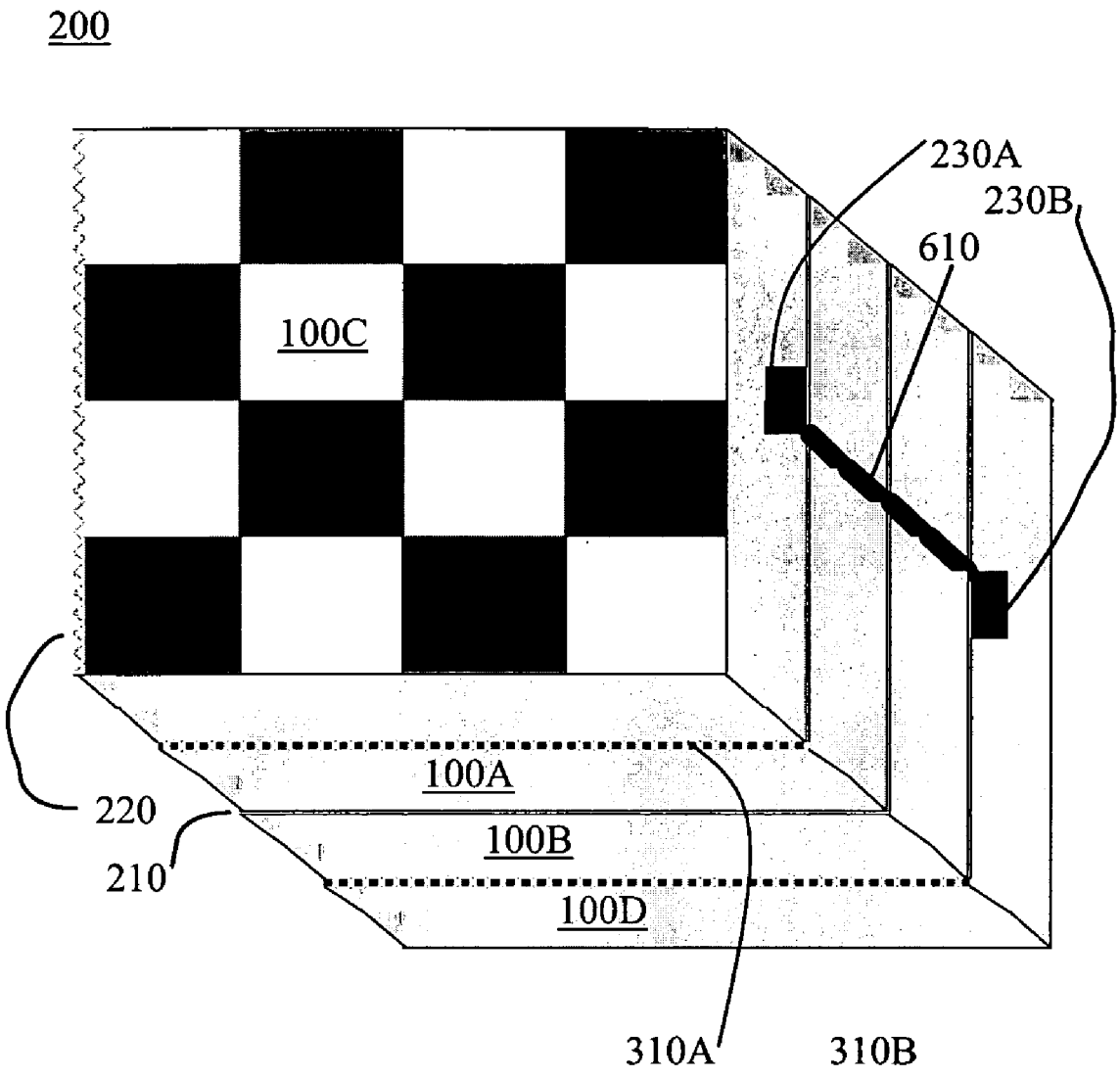
FIG. 6 illustrates the quarter-folding game board in its final storage state according to an exemplary embodiment of the present invention.

FIG. 6 illustrates the quarter-folding game board 200 in its final storage state according to an exemplary embodiment of the present invention. As is illustrated, enclosures 400A,B fold along top joint 210 to place the board 200 in its folded storage state, thereby stacking enclosures 400A,B (comprised of quarter panels 100A-D). To achieve this fold, the groups of quarter panels 100A,C forming enclosure 400A, and 100B,D forming enclosure 400B, are folded along the top surface joint 210 to place the respective top surfaces 105A,B of quarter panels 100A and 100B facing each other.

Additionally, as illustrated in FIG. 6, the latch also can comprise a fastener 610 which attaches to and separates from at least one of the components 330A,B to alternately secure the closed game board 200 or unsecure it in order to permit it to be opened. The latch can comprise any suitable mechanism for holding the game board 200 in its closed position. In an alternative exemplary embodiment, the game board 200 can comprise multiple latches, such as a latch that holds quarter panels 100C and 100A together, a latch that holds quarter panels 100A and 100B together, and a latch that holds quarter panels 100B and 100D together. It should be noted that other methods may be used for securing the invention, including, but not limited, the use of magnets, Velcro™, or another manner of clasp or fastener along or within the bottom surfaces 100, or side walls 140 of the invention, without departing from the scope and spirit of the current invention.

The game board 200 described herein permits use, portability, and storage of the game board and associated playing pieces. This board 200 offers the advantages of folding compactly into quarters while also offering storage capacity comparable to that afforded by of a traditional game board which folds in half. Accordingly, by means of the present invention, the benefit of a large playing surface may be combined with enhanced portability and storage convenience.

Many other modifications, features, and embodiments of the invention will be evident to one of ordinary skill in the art. It should be appreciated, therefore, that many aspects of the invention were described above by way of example only and are not intended as required or essential elements of the invention unless explicitly stated otherwise. Accordingly, it should be understood that the foregoing relates only to certain embodiments of the invention and that numerous changes may be made therein without departing from the spirit and scope of the invention as defined by the following claims. It should also be understood that the invention is not restricted to the illustrated embodiments and that various modifications can be made within the scope of the following claims.

I claim:

1. A game board, comprising:

a first quarter panel, a second quarter panel, a third quarter panel, and a fourth quarter panel, each of the quarter panels comprising a top surface, an underside of the top surface, and four side walls disposed along a perimeter of the underside of the top surface, the four side walls together comprising a bottom surface of the respective quarter panel, and the four side walls together with the underside of the top surface defining a compartment below the top surface of the respective quarter panel;

a top joint that couples the top surface of the first quarter panel to the top surface of the second quarter panel;

a first bottom joint that couples the bottom surface of the first quarter panel to the bottom surface of the third quarter panel; and a second bottom joint that couples the bottom surface of the second quarter panel to the bottom surface of the fourth quarter panel.

2. The game board of claim 1, wherein the first and third quarter panels are foldable along the first bottom joint to dispose the compartment of the first quarter panel opposite the compartment of the third quarter panel, thereby creating a first storage area, and wherein the second and fourth quarter panels are foldable along the second bottom joint to dispose the compartment of the second quarter panel opposite the compartment of the fourth quarter panel, thereby creating a second storage area.

3. The game board of claim 2, wherein the first and second quarter panels are foldable along the top joint to dispose the top surface of the first quarter panel opposite the top surface of the second quarter panel, thereby arranging the first, second, third, and fourth quarter panels in a stacked configuration.

4. The game board of claim 3, further comprising at least one latch that holds the quarter panels in a folded position.

5. The game board of claim 4, wherein the latch comprises a fastener that attaches to two fixed components to hold the quarter panels in a folded position.

6. The game board of claim 1, wherein the respective compartment in each quarter panel comprises a depth, equal to approximately one-half the dimension of a chessboard square presented on the top surface of each quarter panel.

7. The game board of claim 1, wherein the respective compartment in each quarter panel comprises a depth equal to one-half of a depth required to enclose a largest item provided with the game board.

8. The game board of claim 1, wherein the top surface comprises a playing surface.

9. The game board of claim 1, wherein the underside of the top surface comprises a playing surface.

10. The game board of claim 1, wherein the top and bottom joints comprise a hinge.

11. A game board, comprising:

four quarter panels, each of the quarter panels comprising a top surface, an underside of the top surface, and four side walls disposed along a perimeter of the underside of the top surface, the four side walls together comprising a bottom surface of the respective quarter panel, and the four side walls together with the underside of the top surface defining a compartment below the top surface of the respective quarter panel a top joint; and two bottom joints;

wherein the four quarter panels are arranged such that each of two sides of each quarter panel is adjacent to one side of one other quarter panel, wherein the respective top surfaces of two quarter panels are coupled to one another by the top joint, wherein the bottom surface of one of such top-coupled quarter panels is coupled via one of the bottom joints with the bottom surface of one quarter panel which is not so top-coupled, and wherein the bottom surface of the other such top-coupled quarter panel is coupled via the other one of the bottom joints with the bottom surface of the other quarter panel which is not so top-coupled.

12. The game board of claim 11, wherein the respective compartment in each quarter panel comprises a depth approximately equal to one-half of a chessboard square presented on a playing surface of each quarter panel.

13. The game board of claim 11, wherein the respective compartment in each quarter panel comprises one-half of a total depth that accommodates a largest item meant to be stored within the game board.

14. The game board of claim 11, wherein the top surface comprises a playing surface.

15. The game board of claim 11, wherein the underside of the top surface comprises a playing surface.

16. The game board of claim 11, wherein the top and bottom joints comprise a hinge.

17. The game board of claim 11, further comprising at least one latch that holds the quarter panels in a folded position.

18. The game board of claim 17, wherein the latch comprises a fastener that attaches to two fixed components to hold the quarter panels in a folded position.

19. A game board, comprising:

a first quarter panel, a second quarter panel, a third quarter panel, and a fourth quarter panel, each of the quarter panels comprising a playing surface component comprising a first surface and a second surface, and four side wails disposed along a perimeter of the second surface, the four side walls together comprising a compartment surface of the respective quarter panel, the compartment surface disposed opposite to the playing surface component, and the four side walls together with the second surface defining a compartment below the playing surface component of the respective quarter panel;

a first bottom joint that couples the compartment surface of the first quarter panel to the compartment surface of the third quarter panel, wherein the first and third quarter panels are foldable along the first bottom joint to dispose the compartment of the first quarter panel opposite the compartment of the third quarter panel, thereby creating a first storage area;

a second bottom joint that couples the compartment surface of the second quarter panel to the compartment surface of the fourth quarter panel, wherein the second and fourth quarter panels are foldable along the second bottom joint to dispose the compartment of the second quarter panel opposite the compartment of the fourth quarter panel, thereby creating a second storage area; and a top joint that couples the first surface of the first quarter panel to the first surface of the second quarter panel, wherein the first and second quarter panels are foldable along the top joint to dispose the first surface of the first quarter panel opposite the first surface of the second quarter panel.

20. The game board of claim 19, wherein the respective compartment in each quarter panel comprises a depth equal to at least one-half a dimension of a chessboard square presented on the playing surface component of each quarter panel.

21. The game board of claim 19, wherein the respective compartment in each quarter panel comprises a depth equal to at least one-half of a dimension of a largest item provided with the game board.

22. The game hoard of claim 19, wherein the first surface of the playing surface component comprises a playing surface.

23. The game board of claim 19, wherein the second surface of the playing surface component comprises a playing surface.

24. The game board of claim 19, wherein the top and bottom joints comprise at least one hinge.

25. The game board of claim 19, further comprising at least one latch that holds the quarter panels in a folded position.

26. The game board of claim 11, wherein the quarter panels that are coupled via the one of the bottom joints are foldable along the one of the bottom joints to dispose the compartments of those quarter panels opposite each other, thereby creating a first storage area, and wherein the quarter panels that are coupled via the other one of the bottom joints are foldable along the other one of the bottom joints to dispose the compartment of those quarter panels opposite each other, thereby creating a second storage area.

27. The game board of claim 26, wherein the quarter panels that are coupled via the top joint are foldable along the top joint to dispose the top surface of those quarter panels opposite each other, thereby arranging the four quarter panels in a stacked configuration.

* * * * *